United States Patent [19]

Scheldorf et al.

[11] Patent Number: 4,960,372

[45] Date of Patent: Oct. 2, 1990

[54] COMPRESSOR WITH AN ISOLATED VANE SLOT

[75] Inventors: Gary O. Scheldorf, Greenville, Ind.; James F. Gordon; Owen H. Scheldorf, both of Louisville, Ky.

[73] Assignee: General Electric Company, Louisville, Ky.

[21] Appl. No.: 414,465

[22] Filed: Sep. 29, 1989

[51] Int. Cl.[5] ..... F04C 18/332

[52] U.S. Cl. ..... 418/63; 418/157; 418/181

[58] Field of Search ..... 418/63, 181, 243, 157, 418/244, 245, 246, 247, 248, 249, 250, 251

[56] References Cited

U.S. PATENT DOCUMENTS 4,427,351 1/1984 Sano ..... 418/63
4,537,567 8/1985 Kawaguchi et al. ..... 418/63
4,629,403 12/1986 Wood ..... 418/1
4,747,761 5/1988 Yumiyama et al. ..... 418/46

FOREIGN PATENT DOCUMENTS 83877 3/1989 Japan ..... 418/63

*Primary Examiner*—Michael Koczo
*Assistant Examiner*—Douglas J. Makosy
*Attorney, Agent, or Firm*—Radford M. Reams; H. Neil Houser

[57] ABSTRACT

A rotary compressor includes a cylinder with a cylindrical compression chamber. A cylindrical piston is eccentrically movable within the chamber. A vane slot extends outwardly in the cylinder from and communicates with the chamber. A vane is reciprocatingly mounted in the vane slot for selective protrusion into and retroaction from the chamber to contact the piston. At least one noise reduction slot projects into the cylinder from its outer peripheral wall near the vane slot and extends completely between the ends of the cylinder.

5 Claims, 2 Drawing Sheets

COMPRESSOR WITH AN ISOLATED VANE SLOT

BACKGROUND OF THE INVENTION

Refrigeration compressors emit an unacceptable level of noise. Many attempts have been made to dampen, absorb or otherwise effectively eliminate such emitted noise. None of them have been completely satisfactory for all types of compressors and applications.

As the piston moves or rotates in the compression chamber of a rotary compressor the vane moves in and out of the chamber to maintain contact with the side of the piston. This causes varying amounts of vane surface to be exposed to the fluid in the chamber. Since the vane divides the chamber between a suction, or low pressure, side and a compression or high pressure, side a varying pressure differential is applied to the exposed portion of the vane. The net result is that the vane moves from side to side within the slot and repeatedly strikes the cylinder, even though the vane and slot are formed for a close sliding fit. These strikings cause vibrations which travel through the cylinder and are emitted from the compressor as noise.

SUMMARY OF THE INVENTION

It is a general object of the present invention to provide a rotary compressor mechanism in which noise emission is effectively limited.

It is another object of the present invention to provide such a compressor mechanism in which conduction of noise away from the vane and vane slot interface is minimized.

It is yet another object of the present invention to provide such a compressor mechanism in which means is provided to damp vibrations resulting from lateral contact between the vane and cylinder.

In accordance with one form of the invention we provide a rotary compressor including a cylinder having an outer peripheral wall and a pair of spaced apart end walls. A cylindrical compression chamber is provided in the cylinder and a cylindrical piston is eccentrically movable within the chamber. A vane slot in the cylinder extends outwardly from and communicates with the chamber. A vane is reciprocatingly mounted in the vane slot for selective protrusion into and retraction from the chamber to contact the piston as it moves within the chamber, dividing the chamber into a suction side and a compression side: A suction port communicates with the suction side of the chamber and a discharge port communicates with the compression side of the chamber. At least one noise reduction slot projects into the cylinder from its outer peripheral wall and extends completely between the cylinder end walls.

DESCRIPTION OF THE PREFERRED EMBODIMENTS

The present invention relates to rotary compressors, particularly such compressors including means for reducing the level of emitted noise. For ease of understanding, the drawings of the present application are somewhat simplified and somewhat schematic in form. An example of a rotary compressor in which the present invention may advantageously be incorporated is shown and described in U.S. Pat. No. 4,664,608, assigned to General Electric Company, assignee of the present invention, which patent is herein incorporated by reference.

Figure 1:
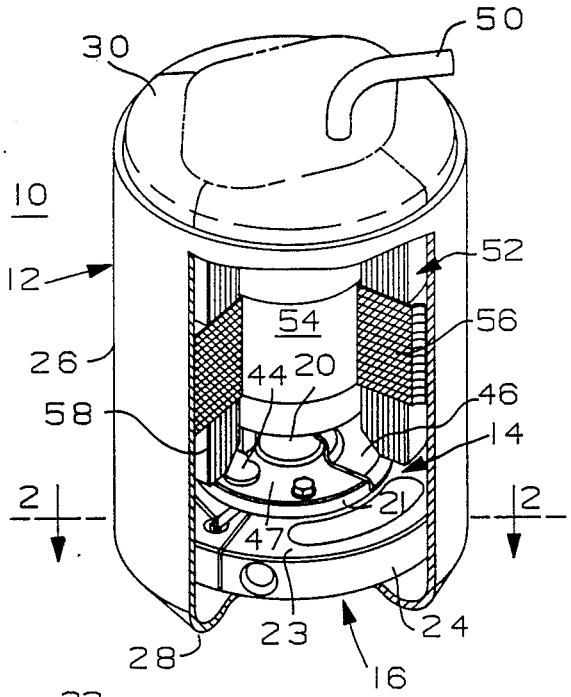
FIG. 1 is a side perspective view of a rotary compressor incorporating one embodiment of the present invention, the view being somewhat simplified and partially broken away for purposes of illustration.
Figure 2:
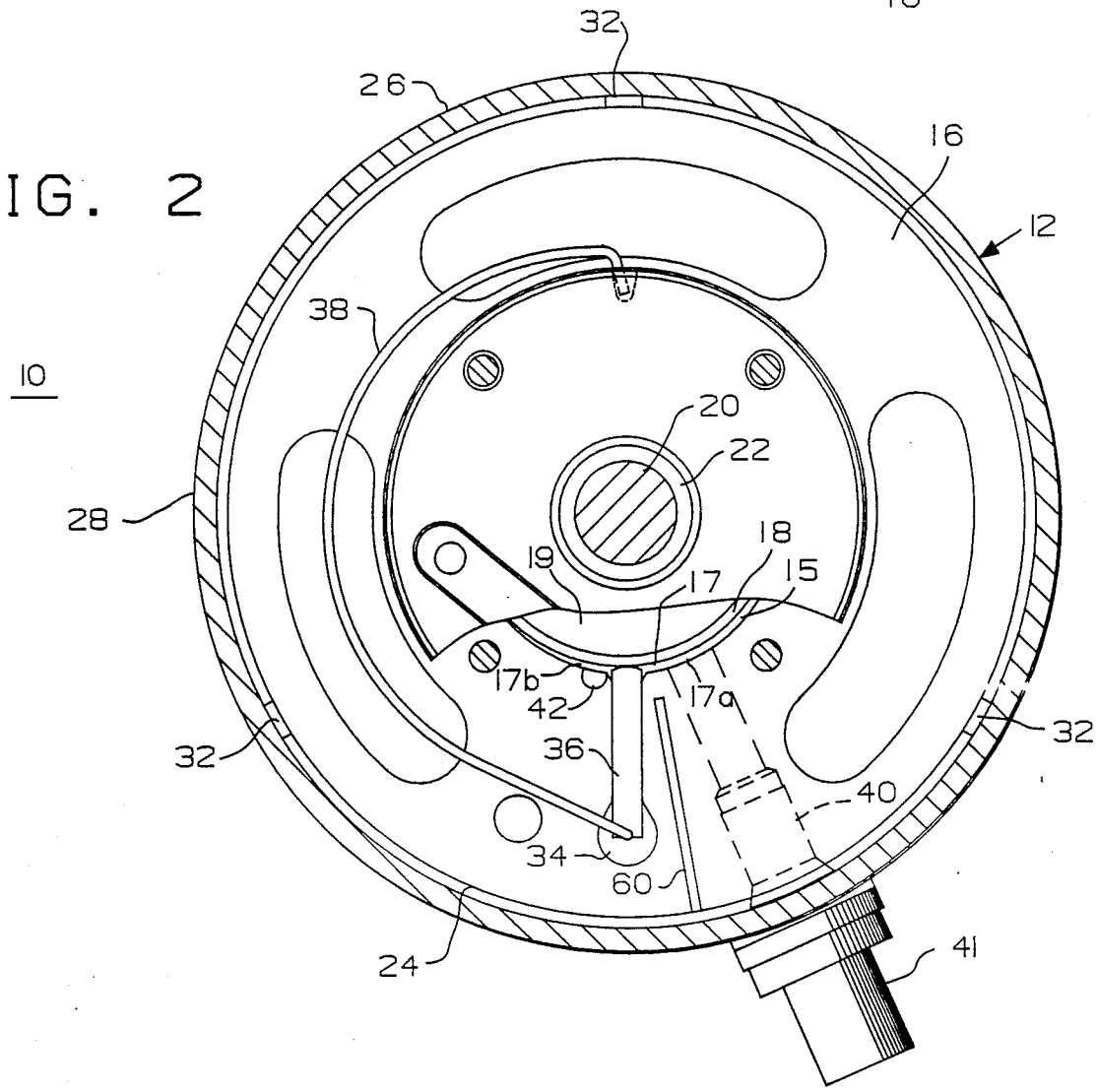
FIG. 2 is an enlarged cross-sectional view generally as seen along the line 2—2 in FIG. 1.

Referring now to FIGS. 1 and 2 of the drawings, there is shown a hermetic compressor 10 including a hermetically sealed casing 12 in which is disposed a refrigerant compressor unit 14 having a cylinder 16. As is conventional with rotary compressors, a compression chamber 17 is formed within the cylinder 16 and a roller 18 is positioned within the chamber and is driven by a cylindrical eccentric 19 formed as an integral part of the drive shaft 20. The roller 18 and eccentric 19 form a cylindrical rotary piston which is mounted to move eccentrically in chamber 17. More specifically, as is well known in the art, the axial center line of the eccentric 19 is offset with respect to the center line of chamber 18 and shaft 20. As the shaft rotates the area of contact between the roller 18 and the inner peripheral wall 15 of the cylinder 16 moves around the circumference of wall 15. The top of the chamber 17 is closed by a main frame or upper end wall 21 which includes a hollow journal bearing 22 that supports the shaft 20. Specifically main frame 21 is bolted or otherwise secured in fluid tight relationship to one end wall 23 of the cylinder 16. As is conventionally, spaced from end wall 23 is a lower cylinder end wall (not shown) and a bottom plate (not shown) is secured against the lower cylinder end wall to seal chamber 17 and support the distal end of shaft 20.

The cylinder 16 is provided with a vane slot 34 which communicates with and extends generally radially outward from compression chamber 17. A blade or vane 36 is slidably mounted in slot 34 for selective movement between protrusion into the chamber 17 and retraction from the chamber. The vane 36 is biased by a spring 38 so that its radially inner end is continuously in engagement with the peripheral surface of the roller 18, thereby dividing the chamber 17 into a suction or low pressure side **17*a* and a compression or high pressure side 17*b***.

The casing 12 includes a side wall 26, a lower end wall 28 and a upper end wall 30. Conveniently the side wall 26 and lower end wall 28 may be formed from one piece of metal while the upper end wall 30 is formed separately and is attached to the side wall 26 by some convenient method such as welding after the operative components of the compressor have been assembled within the casing. However it will be understood that other casing constructions are acceptable. The outer peripheral wall 24 of cylinder 16 is welded to the casing side wall 26 at selected positions around the circumference of the side wall to support the compressor unit 14 within the casing 12. For purposes of illustration three such welds 32 are shown; however, other numbers of spot welds may be used if desired.

Means for delivering suction or low pressure gas into the low pressure side of the chamber 17 includes a channel or bore 40 which extends through the side of the cylinder 16 and communicates with the low pressure side 17*a* of chamber 17. The outer end of the channel 40 is provided with a fitting 41 for connection to the end of the refrigerant system suction line. As the drive shaft 20 rotates, the eccentric 19 and roller 18 are moved in a counterclockwise direction within the chamber 17 compressing the refrigerant gas within the chamber. A discharge port 42, formed in the cylinder 16 and the main frame or upper end wall 21, is closed by a valve 44. When the gas pressure within the high pressure side 17*b* of chamber 17 builds to a sufficiently high level it causes the valve 44 to open and the gas in the high pressure side discharges into the hermetic casing 12.

A cap 46 fits tightly around the peripheral edge of the upper end wall 21 and is spaced slightly from the journal bearing 22 to form a discharge chamber 47. Gas flowing by the valve 44 is first received in the discharge chamber, which acts a muffler to reduce noise of the high pressure gas passing from the chamber 17 into the hermetically sealed casing 12. The gas passes from the discharge chamber 47 into the main portion of the compressor casing 12 through the space between bearing 22 and cap 46. High pressure gas discharges from the casing 12 to the refrigerant system through high pressure outlet pipe 50. The compressor 10 also includes a motor 52 having a rotor 54 and a stator including a stator core 56 and windings 58. The rotor 54 is connected to the shaft 20 so that rotation of the rotor causes the piston, comprising eccentric 19 and roller 18, to rotate eccentrically within the chamber 17.

The slot 34 and vane 36 are carefully machined to very close tolerances; however, the vane 36 must be free to easily slide back and forth in slot 34 as the distance between the inner end of slot 34 and roller 18 varies. Therefore, while the vane appears to have a tight fit in the slot, the differences in pressure between the low side 17*a* and the high side 17*b* cause the vane 36 to strike or slap against the sides of slot 34. Since both the area of vane 36 exposed to chamber 17 and the difference in pressure between suction side 17*a* and compression side 17*b* varies significantly, the lateral forces on vane 36 vary and the vane tends to strike the cylinder repeatedly.

The repeated striking of the vane 36 against the side walls of vane slot 34 sets up vibrations in the vane 36 and cylinder 16. These vibrations tend to travel both around and outwardly of cylinder 16. From the outer edge of cylinder 16 they are transferred to casing 12 and then are emitted as noise. Viewing FIGS. 1 and 2, in order to dampen out these vibrations, we provide a noise reduction slot 60. More specifically, the slot 60 is located close to vane slot 34; it projects inwardly from the cylinder outer wall 24, preferably in a generally radially fashion; it extends completely through the cylinder 16, that is completely between the cylinder end walls; and it terminates outwardly of the cylinder inner wall 21 so as not to sever the cylinder and harm the fluid tight integrity of the chamber 17. Preferably, as best seen in FIG. 2, the noise reduction slot is positioned on the low pressure side of the vane slot 34, between the vane slot and the suction inlet duct 40. The noise reduction slot acts to interrupt the path of vibration in the cylinder and effectively dampen vane noise.

Figure 3:
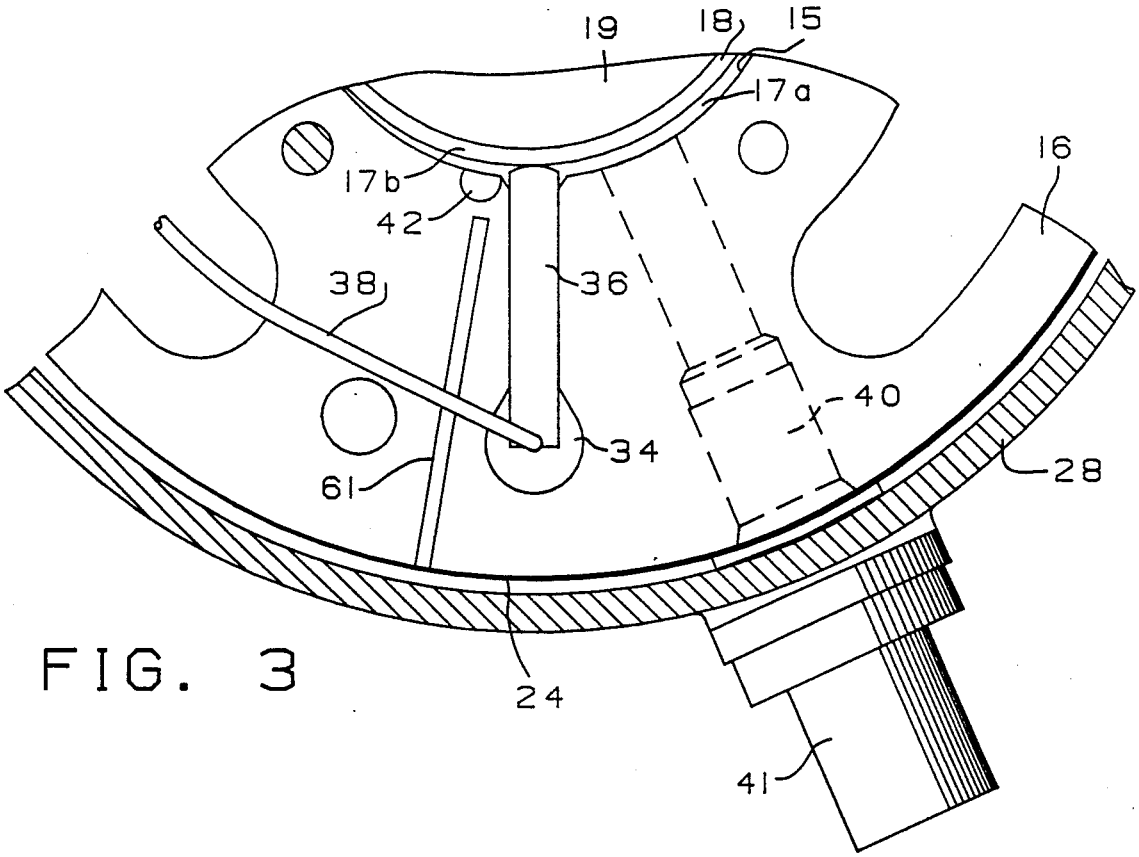
FIG. 3 is an enlarged fragmentary cross-sectional view similar to FIG. 2 but showing another embodiment of the present invention.
Figure 4:
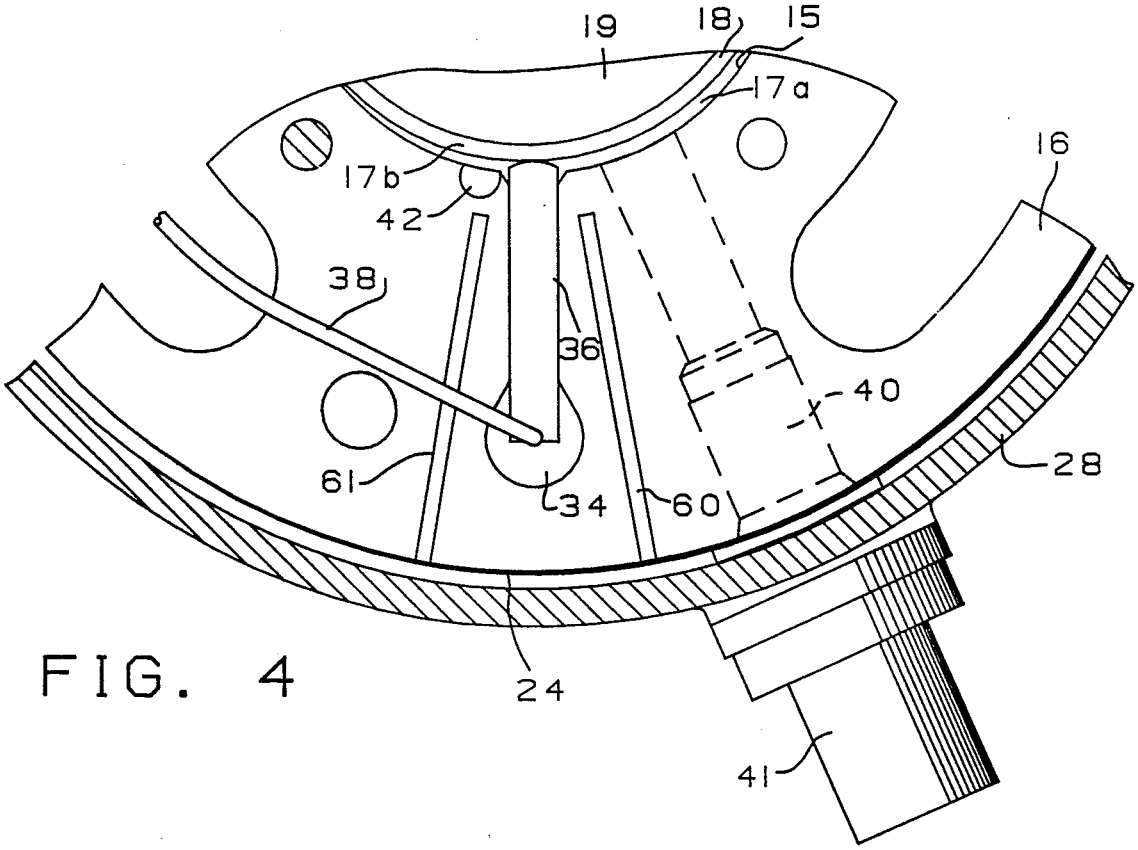
FIG. 4 is an enlarged fragmentary cross-sectional view as in FIG. 3 but illustrating still another embodiment of other present invention.

Placement of the noise reduction slot in the exact position shown in FIG. 2 is not critical. In the embodiment shown in FIG. 3, for example, a noise reduction slot 61 is positioned on the high pressure side of the vane slot 34, generally in alignment with discharge opening 42. In other respects the construction is like that shown in FIGS. 1 and 2. Likewise, in FIG. 4 a first noise reduction slot 60 is provided to the low pressure side of vane slot 34 and a second noise reduction slot 61 is provided to the high pressure side of vane slot 34.

The embodiments described heretofore are considered to be the presently preferred forms of the invention. However, in accordance with the patent statutes changes may be made in the disclosed apparatus and its manner of construction without actually departing from the true spirit and scope of the invention.

What is claimed is:

1. A rotary compressor comprising:

a cylinder having an outer peripheral wall and a pair of spaced apart end walls and a cylindrical compression chamber therein;

a cylindrical piston eccentrically movable within said chamber;

a vane slot in said cylinder extending outwardly from and communicating with said chamber;

a vane reciprocatingly mounted in said vane slot for selective protrusion into and retroaction from said chamber so as to contact said piston as it moves within said chamber to divide said chamber into a suction side and a compression side;

a suction port positioned on the suction side of said vane and communicating with said chamber, and a discharge port positioned on the compression side of said vane and communicating with said chamber; and at least one noise reduction slot projecting into said cylinder from its outer peripheral wall near said vane slot and extending completely between said end walls.

2. A rotary compressor as set forth in claim 1 wherein said at least one noise reduction slot is positioned to the suction side of said vane slot.

3. A rotary compressor as set forth in claim 1 wherein said at least one noise reduction slot is positioned between said vane slot and said suction port.

4. A rotary compressor as set forth in claim 1 wherein said at least one noise reduction slot is positioned on the compression side of said vane slot.

5. A rotary compressor as set forth in claim 1 wherein a first noise reduction slot is positioned to the suction side of said vane slot and a second noise reduction slot is positioned to the compression side of said vane slot.

* * * * *